United States Patent [19]

DeGroat

[11] Patent Number: 4,598,940

[45] Date of Patent: Jul. 8, 1986

[54] COMBINED LATCH AND HINGE FOR VEHICLE COVERS

[76] Inventor: Philip M. DeGroat, 823 Pine St., Endicott, N.Y. 13760

[21] Appl. No.: 681,286

[22] Filed: Dec. 13, 1984

[51] Int. Cl.[4] ..... E05C 3/04

[52] U.S. Cl. ..... 292/108; 16/230; 292/DIG. 17

[58] Field of Search ..... 292/210, DIG. 17, 190, 292/241, 101, 108; 16/230, 231, 371

[56] References Cited

U.S. PATENT DOCUMENTS

| | | | |
|---|---|---|---|
| 479,936 | 8/1892 | Foster | 16/231 |
| 489,386 | 1/1893 | Morris | 292/101 |
| 2,886,375 | 5/1959 | Crawford | 16/231 X |
| 3,217,661 | 11/1965 | Kemp | 292/241 X |
| 3,810,273 | 5/1974 | Shute | 16/230 X |
| 3,811,718 | 5/1974 | Bates | 292/241 |
| 4,370,874 | 2/1983 | Munn | 292/210 |

FOREIGN PATENT DOCUMENTS

| | | | |
|---|---|---|---|
| 10488 | of 1891 | United Kingdom | 292/190 |

*Primary Examiner*—Robert L. Wolfe
*Assistant Examiner*—Russell W. Illich
*Attorney, Agent, or Firm*—Barnard & Brown

[57] ABSTRACT

A combined hinge and latch mechanism for vehicle tops or "caps", which allows the cap to be lifted from either side. The mechanism has two parts, a plate which mounts to the truck or other vehicle bed and a latch, comprising a rod having handle and semicircular parts, and a pivot point, which mounts to the vehicle cap. Rotation of the rod engages and disengages with the plate to latch and unlatch the mechanism. When latched the two elements may be pivoted on each other providing a hinge.

5 Claims, 6 Drawing Figures

COMBINED LATCH AND HINGE FOR VEHICLE COVERS

BACKGROUND OF THE INVENTION

The invention pertains to the field of latching apparatus especially useful for covers for areas of motor vehicles. More specifically, the invention presents a combined hinge and latch for vehicle covers, which would allow a vehicle cap to be raised and lowered from either side of the vehicle.

DESCRIPTION OF RELATED ART

So called "caps" for pickup trucks are well known to the art. A truck cap is a cover usually detachable for the load carrying bed of a pickup truck or the like. Truck caps are especially popular in areas such as the northeast, where the bed of the pickup truck has a tendency to fill up with snow during the winter. The truck cap typically will cover the entire rear of the pickup, and may be arched so as to provide a large enclosed area, or flat so as to create a "trunk" and flat load carrying area on top. Most commonly truck caps are built so as to enclose an area in the rear somewhat akin to a station wagon type arrangement, with a liftable rear window for access to the rear of the cap over the existing truck tailgate.

This restriction of the ability to get at the pickup truck bed, that is, only through the rear, can prove to be a difficulty at times. It would be useful to be able to lift a truck cap from either side in order to obtain easier access to the bed.

Several arrangements for enabling a cap to be opened from either side have been suggested in the prior art. Crawford, U.S. Pat. No. 2,886,375 (1959) shows such a truck cap which may be lifted from either side. Crawford's arrangement requires an internal arrangement of rods and hooks which is complicated, and takes up room inside the cap. Others, such as VanAntwerp, U.S. Pat. No. 3,572,821 (1971); Strong, U.S. Pat. No. 3,508,787 (1970) or Pounds U.S. Pat. No. 3,180,674 (1965) have come up with truck beds which may pivot to either side which depend on hinges or pivots which fit in stake bed holes in the truck bed sides. These present the problem that not all trucks have stake bed holes, and the pins do not form a particularly sturdy attachment. Each of these require some complicated interlocking mechanism which fits inside the truck cap. Those without hinges are prone to scratching the truck body when lifted.

Spanke, U.S. Pat. No. 4,181,351 (1980) discloses a cover for pickup truck beds which can open from either side, in which the cap pivots on hinges from which the pins may be pulled by means of a key allowing one side or the other to be lifted. Spanke's invention has the problem that the hinge pins fitting in relatively small holes would be difficult to use and would require use of the key on either side.

It is therefore an object of this invention to provide a method of fastening a truck cap or other vehicle covered which will allow the cover to be lifted from either side, and which is simple, easy to use and does not take up room inside the truck bed.

SUMMARY OF THE INVENTION

The invention comprises a combined hinge and latch mechanism for truck caps. The mechanism comprises a plate which is mounted on the "gunwhale" of the pickup truck bed, and which forms a support and hold-down for the latch mechanism which is mounted to the truck cap. The latch mechanism is made up of a rod element which has a handle part and a part which is a semicircle having a radius and a center of arc. Centered on the center of arc is a bearing or pivot on which the rod may be turned. The pivot rides on the plate to allow the rod element to pivot, the arc portion of the rod fitting through two holes in the plate and engaging the plate. This holds the cap down on the side on which the cap is to pivot and, when latched, holds the cap firmly to the truck.

To tilt the truck cap the latch or latches on one side are rotated around the pivot, withdrawing the semicircular part of the rod from the holes in the plate and releasing the cap on that side. The cap is lifted and the semicircular part of the rod on the mechanism on the other side pivots in the holes in the plate creating a hinge.

DESCRIPTION OF THE PREFERRED EMBODIMENTS

Figure 1:
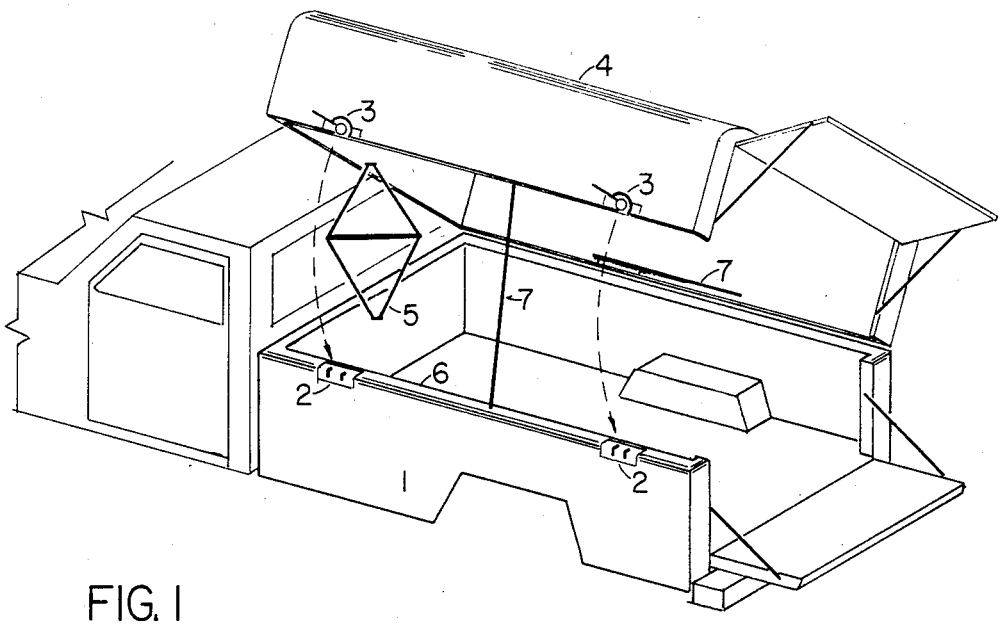
FIG. 1 shows the invention as installed in a pickup truck with the truck cap tilted.

FIG. 1 shows the invention in use in a pickup truck. As can be seen, the invention comprises two major portions. A first part, the plate member (2), is mounted to the truck bed (1) on top of the "gunwhale" (6). A second part, comprising the latch member (3), is mounted to the truck cap (4) along the bottom edge. The dotted lines in FIG. 1 show the latch members engaging with the plate members.

Optionally, a scissors type counter-balance (5) may be provided at the center of the truck bed on the forward end thereof, in order to remove some of the weight of the cap while it is tilted. In addition to, or in place of, the counter-balance, a prop rod (7) could be provided to hold the cap in an upright position, as is commonly used on many car hoods.

Preferably, four complete hinge/latch assemblies will be used on a truck cap, two on each side. It will be recognized, however, that, under proper circumstances, one or three could be provided on either side, or any other combination as desired. If it is desirable for the top to be allowed to lift only from one side, the hinge/latch of the invention could still be used as a latch only, with conventional hinges on the other side, or with a conventional latch on the other side, using the hinge/latch as a hinge which is easily undone to remove the cap.

Although the invention is described herein solely in terms of pickup truck caps, it will also be recognized that the mechanism of the invention could be used in other applications than pickup truck caps, such as vehicle hoods or trunks, covers for farm equipment or trailers, utility equipment covers, etc.

Figure 2:
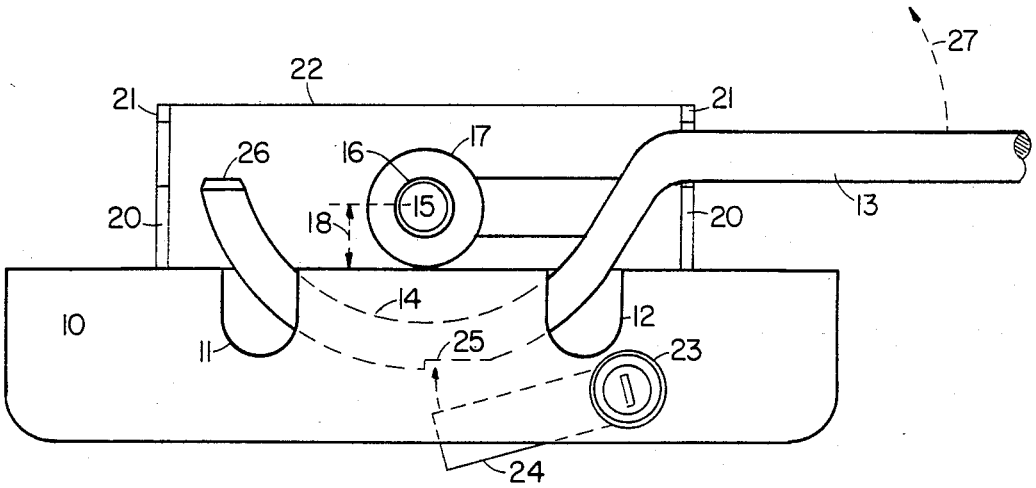
FIG. 2 shows a diagram of one of the latch/hinge mechanisms of the invention.

FIG. 2 shows a detail of one of the latch/hinge mechanisms of the invention. Referring first to the latch portion of the invention, it will be seen that there are two major elements to the latch. A rod element, preferably made of a single length of metal rod circular in cross-section, is bent to form two portions. The handle portion (13) is preferably straight in the horizontal plane, with an outward bend (away from the cap) to allow clearance between the handle and the cap and provide a space for the user to hold the rod element for activation. The rest of the rod element is bent into an arcuate portion (14) which is semicircular in form, being bent at a constant radius around a center of curvature (15).

The point or tip of the rod element (26) may be pointed, or rounded, or conical for ease of location and use. The point acts as a "pilot" for guiding the rod element.

Attached to the rod element by a connector of some kind (19) is the second element of the latch, a pivot element or bearing (17). The pivot element is preferably of circular arrangement, in the form of a disk, as shown in FIGS. 2 and 3. The pivot element is centered, and pivots upon, the same center of curvature as the arcuate portion of the rod element (14), in this case shown as a bolt (15). As discussed below, this bolt may also serve to mount the latch to the cap. The pivot element may be provided with a bushing (16) to allow it to rotate freely about the center of rotation.

The pivot element serves two purposes. When the rod element is turned around the pivot, the pivot element rides on the plate element (10), supporting the cap and allowing the rod to rotate around the center of curvature of the arcuate portion (14). When the cap is lifted and the mechanism is acting as a hinge, the bottom portion of the pivot element serves as bearing riding on arcuate portion of the plate element (10).

Figure 3A:
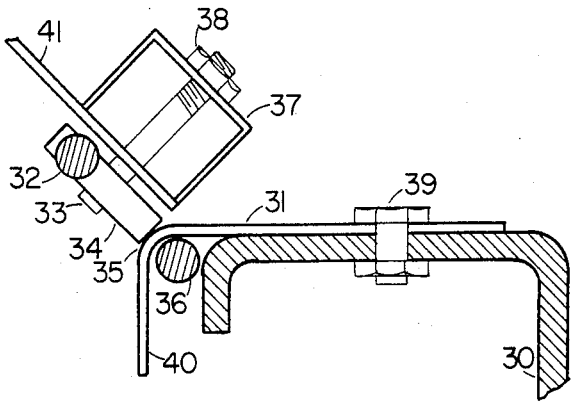
FIGS. 3A and 3B show a side view of the invention, latched and used as a hinge, in tilted and vertical positions.
Figure 3B:
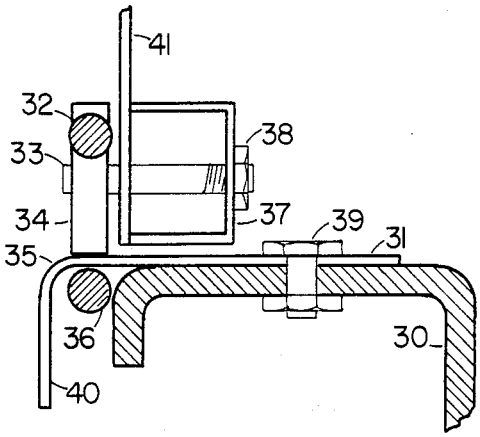

The plate element (10), as can be seen in FIG. 2 and FIG. 3 is adapted to mount upon the gunwhales of the truck bed. It comprises a horizontal portion (31) and a vertical portion at right angles thereto (40) and an arcuate portion (35) between. The plate is preferably made out of a single piece of metal, such as steel, with a smooth bend between the two portions. The arcuate portion (35) provides a surface upon which the pivot element (34) may ride as the cap is opened (FIG. 3A) and closed (FIG. 3B).

Referring to FIG. 2 again, the plate element has two holes (11) and (12). These holes are centered in the arcuate portion of the plate element and spaced apart such that the arcute portion of the rod element may pass through one hole (12) and out the other (11) as the rod is pivoted about the pivot (15).

Figure 5:
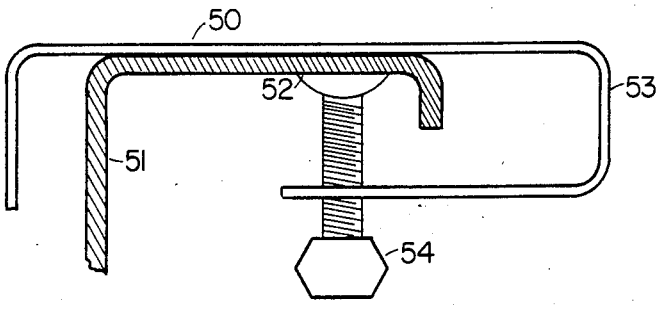
FIG. 5 shows an alternate embodiment of the plate member, incorporating a clamp.

The plate is fastened to the truck bed gunwhales by any convenient method, such as by bolts (39) or alternatively by means of a clamp (FIG. 5—(53)) having a screw (54) to tighten the plate (50) down to a lip (52) of the truck gunwhales (51). The later arrangement is useful in trucks which have such an inside lip, which includes most pickups. For trucks such as Toyotas or Datsuns, which have outside lips as shown in FIGS. 3A and 3B, the bolt mounting is necessary. The horizontal portion of the plate may be made in varying lengths to allow for variations in bed and cap sizes.

The holes (11) and (12) are preferably elongated in nature, having a portion which is extended down into the vertical portion of the plate element. This allows the arcuate portion of the rod element (14) to more easily rotate through the hole as the pivot element (34) rides down the arcuate portion of the plate element (35) as the cap is opened.

As an additional feature a stop plate (22) may be mounted behind the rod element and against the truck cap. The stop plate may have a stop on one or both ends (20) against which the handle portion of the rod element (13) may rest when in the fully closed or open position, and a snap pin (21) to hold the handle element down when it is in position.

As shown in FIGs. 3A and 3B, the pivot point bolt (33) of the latch mechanism may be used to mount the mechanism by extending it through the side of the cap (41) and the cap structure (37) and securing it with an appropriate nut (38). To prevent removal of the bolt (and thus the cap) from the outside, a locking nut is preferred.

Optionally a lock (23) may be provided to hold the handle in the latched position. The lock would be provided with a locking cam (24) which could be pivoted into a notch (25) in the arcuate portion of the rod element (14). When the lock (23), mounted in the vertical portion of the plate element (10), is turned the lock cam (24) engages the notch (25) and the rod element may not pivot in the holes.

The operation of the mechanism may be described as follows: Referring to FIGS. 2 and 3A and B, the mechanism is shown in the latched position in these Figures. In this position the cap may be pivoted, using the mechanism as a hinge. As can be seen in FIGS. 3A and B when this is done the pivot element (34) rides on the arcuate portion of the plate element (35) as a bearing, and the cap (41) may be tipped within the limits of the elongated slots (11) and (12). To release the mechanism, the locking cam (24) of the lock (23) is removed from the notch (25) (if any) and the handle element of the rod element (13) is lifted (27) rotating the rod and pivot element (17) about the pivot point (15). The outer surface of the pivot element (17) rides on the horizontal surface of the plate element (31) as the pivot element is pivoted around the pivot point (15) on its bushings (16). When the handle element (13) has been rotated through approximately 180° the arcuate portion of the rod element (14) has been withdrawn completely through the holes (11) and (12) of the plate element (10) and the cap may be lifted (the plate element and rod element separate).

Figure 4:
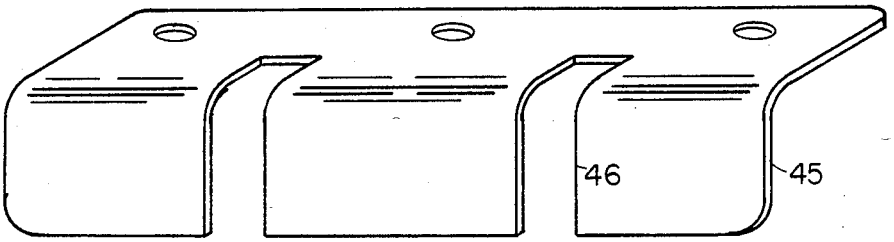
FIG. 4 shows a second embodiment of the plate member with slots instead of holes for the semicircular portion of the rod member to engage.

FIG. 4 shown an alternate embodiment for the plate element, in which the elongated holes are continued down through the entire vertical portion of the plate element (45). This allows the plate element to be used as a tie-down for ropes when the cap is removed completely, giving additional utility to the mechanism even when not in use.

It is to be understood that the embodiments of the invention herein described are merely illustrative of the application of the principles of the invention. Reference herein to details of the illustrative embodiments are not intended to limit the scope of the claims which themselves recite those features regarded as essential to the invention.

I claim:

1. A combined hinge and latch device for covers for vehicles, comprising:

a. a plate element having horizontal and vertical planar portions at right angles to each other, and an arcuate portion therebetween;

b. means for mounting the plate element to the vehicle;

c. a latch element comprising;

1. a rod element having a handle portion and an arcuate portion, the arcuate portion being formed as a semicircle having a radius and center of curvature;
2. a circular pivot element centered upon the center of curvature of the arcuate portion of the rod element, having a radius less than that of the arcuate portion of the rod element;
3. the circular pivot element being attached to at least the handle portion of the rod element, whereby movement of the handle portion of the rod element in an arcuate path causes the pivot element and the arcuate porton of the rod element to pivot around the center of curvature;
4. means for attaching the latch element to the vehicle cover;

d. the plate element having at least two holes therein, in at least the arcuate portion thereof, the holes being of large enough diameter for the arcuate portion of the rod element to freely pass therethrough, and spaced apart sufficiently that the arcuate portion of the rod element may pass through both holes, locking the latch element and plate element together;

e. the radius of the pivot element being chosen such that the pivot element contacts the plate element when the arcuate portion of the rod element is passed through the holes in the plate element, whereby the outer surface of the pivot element rides upon the arcuate portion of the plate element, and the cover may be hinged to the vehicle by the combined plate element and latch element.

2. The combined hinge and latch device of claim 1 in which the holes in the plate element are elongated into at least the vertical portion of the plate element.

3. The combined hinge and latch device of claim 2 in which the elongated holes extend from the arcuate portion of the plate element through the entire vertical portion of the plate element, forming slots.

4. The combined hinge and latch device of claim 1, further comprising locking means for preventing the withdrawal of the arcuate portion of the rod element from the holes in the plate element.

5. The combined hinge and latch device of claim 4, in which the locking means comprises:

a. a notch in the arcuate portion of the rod element, on the surface of the rod element furthest from the center of curvature;

b. locking cam means for engaging the notch, attached to the plate means, whereby the rod element is prevented from relative pivotal movement when the locking cam means is engaged with the notch;

c. lock means for selectively engaging and disengaging the locking cam means from the notch.

* * * * *